US007509913B1

(12) United States Patent
Eagle

(10) Patent No.: US 7,509,913 B1
(45) Date of Patent: Mar. 31, 2009

(54) TABLE BRIDGE

(76) Inventor: Franklin Eagle, 912 Kellum St., Fairbanks, AK (US) 99701

( * ) Notice: Subject to any disclaimer, the term of this patent is extended or adjusted under 35 U.S.C. 154(b) by 4 days.

(21) Appl. No.: 11/788,946

(22) Filed: Apr. 23, 2007

Related U.S. Application Data

(63) Continuation of application No. 10/437,701, filed on May 14, 2003, now abandoned.

(51) Int. Cl.
*A47B 13/08* (2006.01)

(52) U.S. Cl. ..... 108/90; 108/64; 108/65

(58) Field of Classification Search ..... 108/64–66, 108/90, 93, 69, 157.15, 185, 104
See application file for complete search history.

(56) References Cited

U.S. PATENT DOCUMENTS 907,649 A * 12/1908 Stover ..... 108/104
1,392,527 A * 10/1921 Santoro ..... 108/64
2,556,943 A * 6/1951 Reisman ..... 108/90
2,792,226 A * 5/1957 Champion ..... 273/123 R
3,714,906 A * 2/1973 Finestone ..... 108/64
4,146,855 A * 3/1979 Schultz et al. ..... 335/8
4,656,953 A * 4/1987 Miller, Jr. ..... 108/153.1
4,815,393 A * 3/1989 Pollak ..... 108/69
5,341,750 A * 8/1994 Fuchs ..... 108/64
5,485,795 A * 1/1996 Williams ..... 108/69
5,567,775 A * 10/1996 Wang et al. ..... 525/279
5,673,631 A * 10/1997 Guns et al. ..... 108/64

FOREIGN PATENT DOCUMENTS

FR 2704123 * 10/1994 ..... 108/66
JP 05146316 * 6/1993 ..... 108/66

* cited by examiner

*Primary Examiner*—Hanh V Tran
(74) *Attorney, Agent, or Firm*—Michael J. Tavella

(57) ABSTRACT

A table bridge made of sheet steel. The bridge has a metal span that overlaps the tabletops and joins them like a bridge. The bridge butts up to the sides of both tables with a curved wall on the underside of the bridge that is the same diameter as the 36" round tables. The top surface area overlaps the tops of the tables enough to disperse the downward pressure over a wide enough area to be stable. This bridge can be installed in seconds over two tables and, just as quickly can be removed if two separate tables are needed later. The bridges can be stored on the wall. Another variation allows the bridges to be centered on a table to enlarge that table's surface area and seating capacity. Another variation allows a centered bridge to abut another centered bridge and be joined with side pins.

16 Claims, 8 Drawing Sheets

TABLE BRIDGE

CROSS REFERENCE TO RELATED APPLICATIONS

This application is a continuation of application Ser. No. 10/437,701 filed May 14, 2003 now abandoned.

STATEMENT REGARDING FEDERALLY SPONSORED RESEARCH AND DEVELOPMENT

Not Applicable

BACKGROUND OF THE INVENTION

1. Field of the Invention

This invention relates to bridges for connecting tables.

2. Description of the Prior Art

Restaurants use only a few types of tables. These tables are generally either square, rectangular, or round. Typical round tables are 36" in diameter. Although these tables are useful, they are difficult to use when trying to accommodate large groups. To serve larger groups, these tables must be pulled together. While a rectangular table that seats 6 people can be doubled up with another rectangle that seats 5 to 8 people, a group of 6 people can easily pull three round tables together just for the six people in their party. This causes problems because the number of tables is limited and the round tables cannot be combines efficiently.

Several ideas have been developed for combining restaurant tables. For example, U.S. Pat. No. 1,575,954 discloses a tabletop attachment that is a pair of rectangular forms with a semi-circular opening formed in one end. These forms are fitted around a round table and secured with clamps to the round table. U.S. Pat. No. 3,714,906 teaches a form that has a rectangular body and a curved end. The curved end has dowels that fit into grooves cut into the table. In this way, the form is attached to the round table, creating more space. U.S. Pat. No. 5,146,855 teaches a table interconnecting system for joining round tables. This system uses one or more filler pieces that are used to fill in the gaps between two round tables. These forms are secured to the tables with clamps. U.S. Pat. No. 5,341,750 teaches a table system having two tables with four post-type removable legs and a center portion that fits between two of the round table tops. After the top is joined to the tables, the inner legs are removed from the tables and are fitted into receptacles in the form. U.S. Pat. No. 5,568,775 teaches a form that is used to join two round tables together. This form is attached to both tables using bolts and slotted pieces. Thus, system does not provide additional space after the tables are joined. U.S. Pat. No. 5,673,631 teaches a table joining system that uses a lower splice piece to connect the two tables and upper filler pieces to make the table surfaces level and flat. Finally, Design Patent D373,915, shows a rectangular table with folding legs that has a semicircular end. This table is slid up to a round table and attached with clamps.

The problem with all of these devices is that they are either permanent or semi-permanent attachments. Although such arrangements can provide more space, they essentially convert one or two round tables into one larger table that is left in that condition. Modern restaurants need flexibility in their operations. While setting up two or three joint tables permanently, may serve some restaurants, others need the flexibility to move tables around as needed. Moreover, no one would suggest that these table conversions be done on the spot-they require tools and workers to assemble and fasten the parts together-not the kind of atmosphere most restaurants aspire to during meals.

BRIEF DESCRIPTION OF THE INVENTION

The instant invention overcomes all of these problems. It is a table bridge made of sheet steel. The bridge has a metal span that overlaps the tabletops and joins them like a bridge. The bridge butts up to the sides of both tables with a curved wall on the underside of the bridge that is the same diameter as the 36" round tables. The top surface area overlaps the tops of the tables enough to disperse the downward pressure over a wide enough area to be stable. This bridge can be installed in seconds over two tables and, just as quickly can be removed if two separate tables are needed later. Moreover, the shape and appearance of the bridges is such that they can be stored by hanging on the wall-making these pieces truly "Functional Art".

Thus, the bridges serve as a decorative hanging that can be customized with different materials and different look. They can be removed from the wall, to join two round tables, that might seat a combined total of eight people, to form a table that will now comfortably seat 12 people.

An additional benefit of these bridges is that they can span a variety of different distances between tables depending on the stability of the tables' legs. For example, a bridge that spans 1 foot from table edge to table edge produces a seating capacity virtually identical to two separate rounds (8 people). However, a three-foot separation of table edges increases the capacity substantially (e.g., 14 people). There is no limit to the diversity of the configurations that can be made. Multiple bridges can be put on additional tables to make tables that can seat the masses. Another variation allows the bridges to be centered on a table to enlarge that table's surface area and seating capacity. Still another variation allows a centered bridge to abut another centered bridge and be joined with side pins creating a different type of long table.

DETAILED DESCRIPTION OF THE INVENTION

Figure 1:
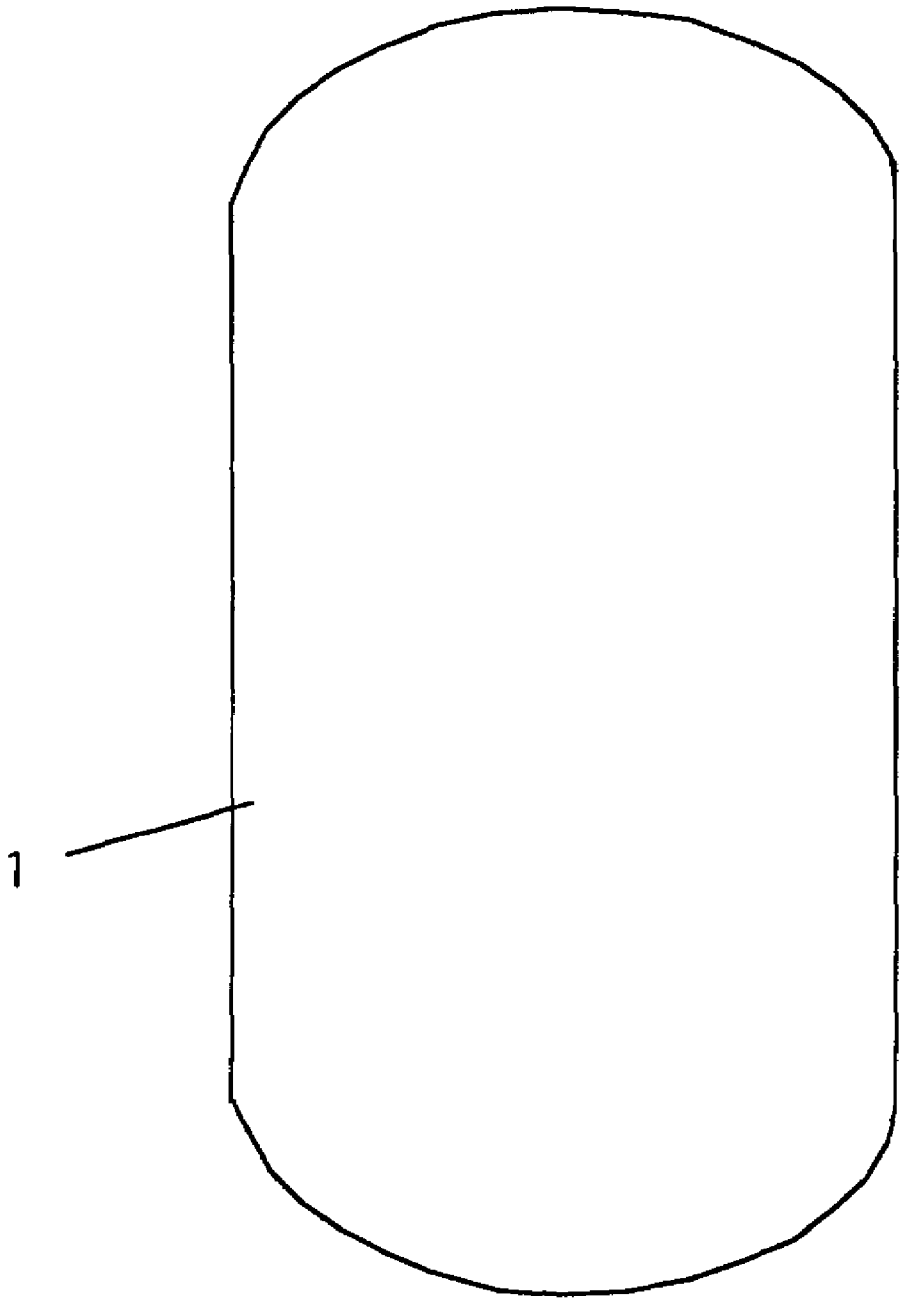
FIG. 1 is a top view of the invention.

Referring now to FIG. 1, the invention 1, from the top, appears as a squared oval. The top of the bridge 1 is made of steel. In the preferred embodiment, the steel is 16 ga. All of the edges are ground smooth. In the preferred embodiment, the top is worked to provide an aesthetic finish, such as that of hammered metal. Alternatively, the top can be painted as desired.

Figure 2:
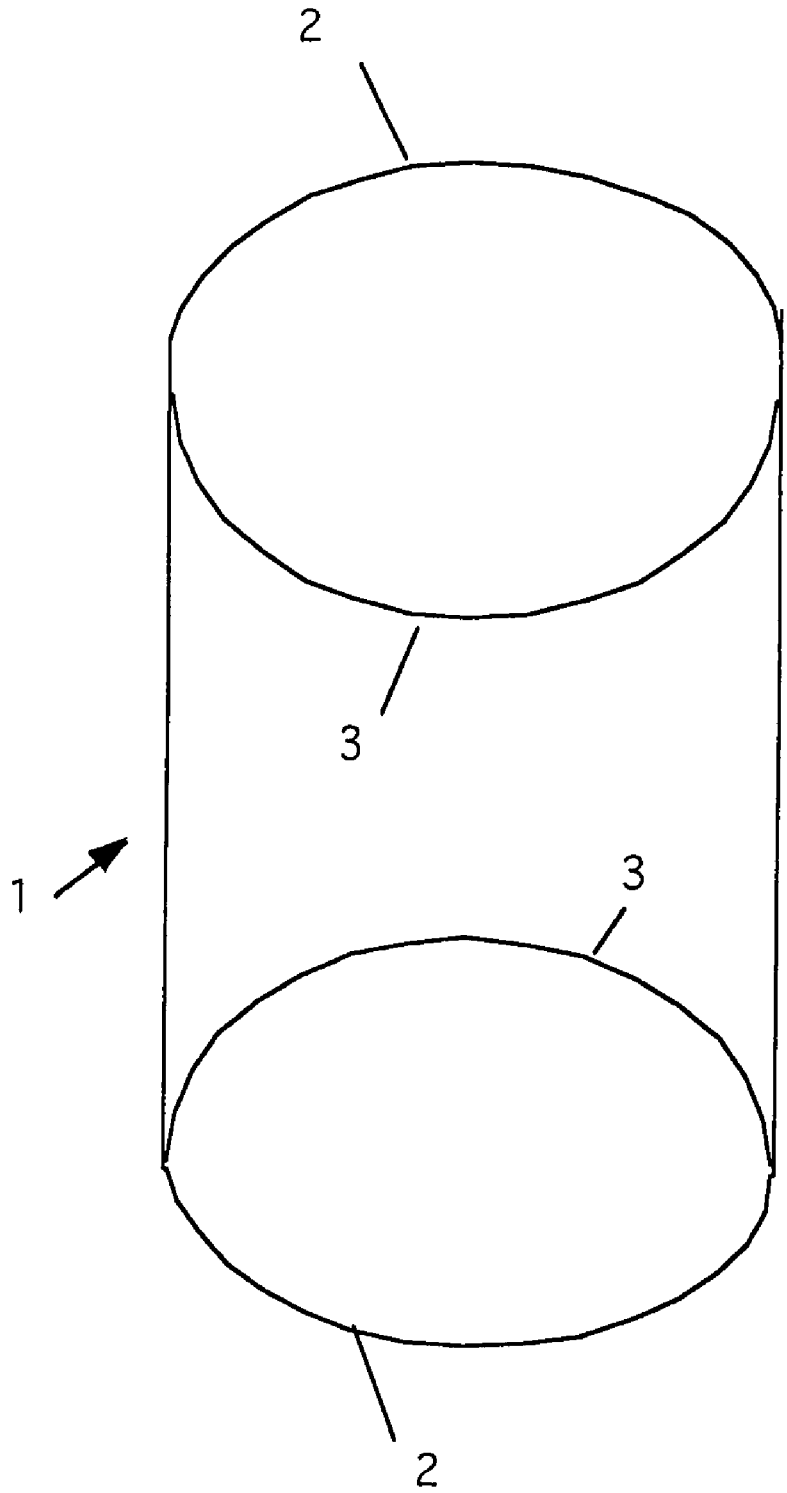
FIG. 2 is a bottom view of the first embodiment of the invention.

FIG. 2 is a bottom view of the first embodiment of the invention 1. The bottom has two curved sections 3 that form the brace portions. These portions extend downward (see FIG. 4). The radii of the curved sections 3 match that of the round table the bridge is joined. For example, a 36-inch diameter table uses a bridge with curved portions of a 36-inch diameter radius. Note that the curved edges 2 are flat and lie atop the tables when the bridge is set in place.

Figure 3:
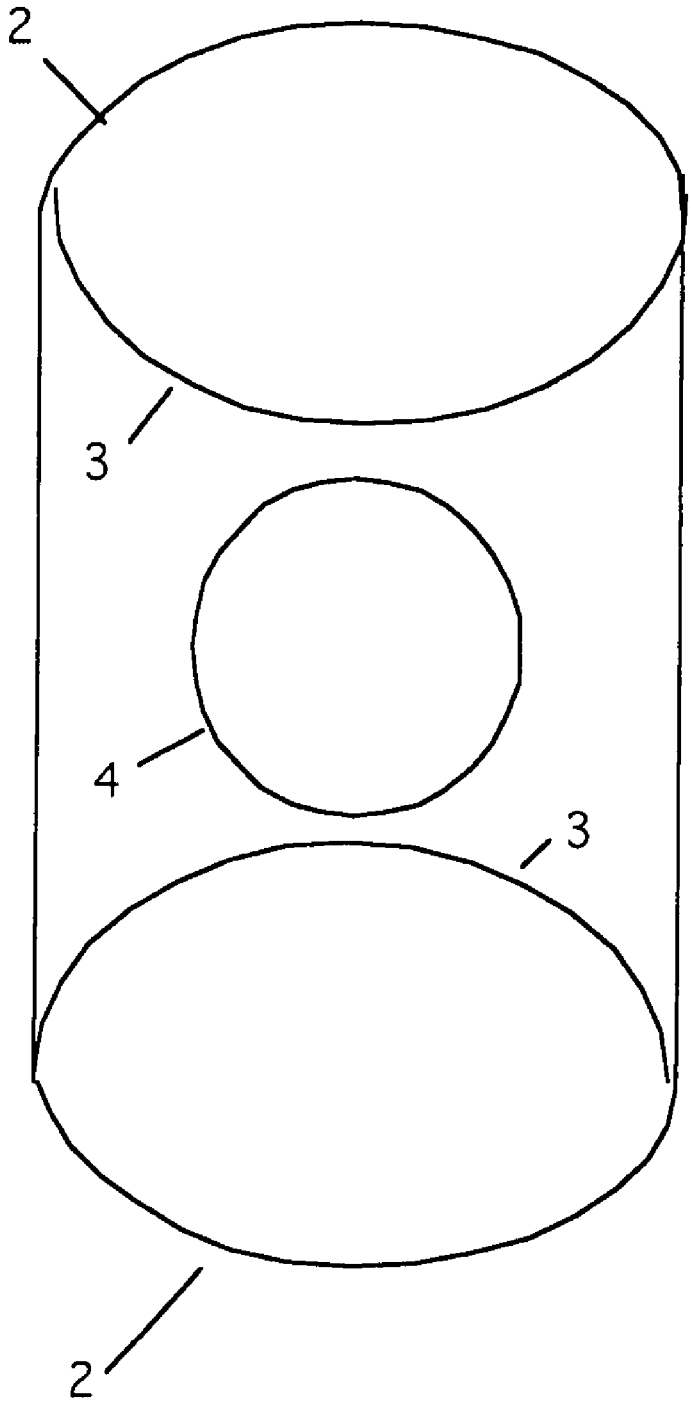
FIG. 3 is a bottom view of the second embodiment of the invention.

FIG. 3 is a bottom view of the second embodiment of the invention. In this embodiment, the curved portions 3 are installed as normal. However, an extra form 4 is added in the center. The center form 4 is designed to fit over smaller round tables (e.g., 20 inches dia.) In this way, a bridge can be used to expand a single small table.

Figure 4:
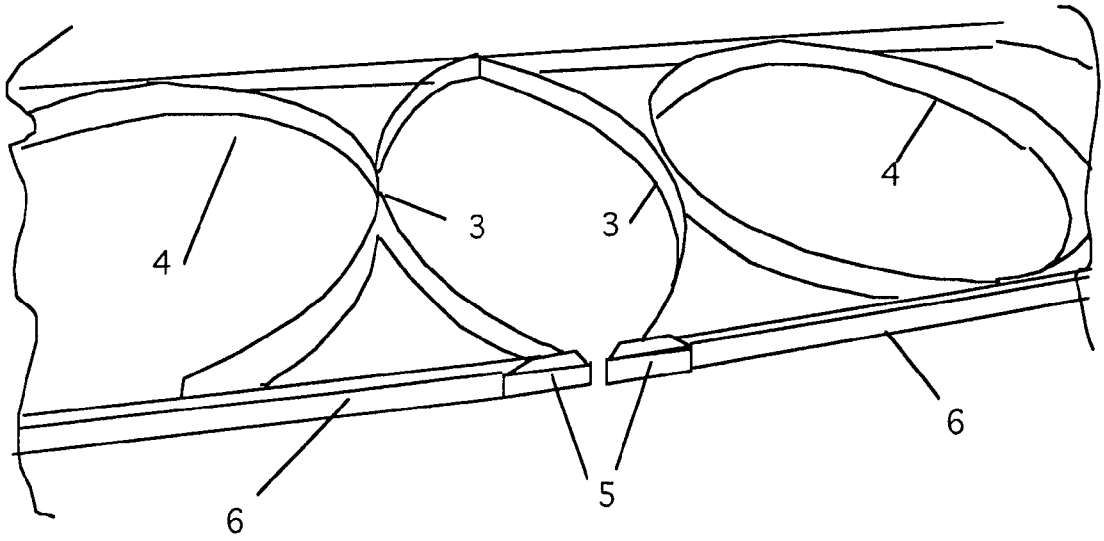
FIG. 4 is a bottom perspective view of two bridges being combined together to make a larger table structure.

FIG. 4 is a bottom perspective view of two bridges being combined together to make a larger table structure. This system is used with the second embodiment. Here, two small tables are joined by placing the center forms 4 of two bridges on two tables. The tables are then brought together until the end 2 of one bridge overlaps the end 2 of the second bridge. The ends of the bridges are secured by clamps 5 that are slid into place. Note also that in this figure, the edge flanges 6 are shown. The edge flanges provide a safe, rounded edge as well as providing a substantive edge to mimic the edge of a table. These edges also give the bridge a more "finished" look both when hanging on a wall and when installed on the tables.

Figure 5:
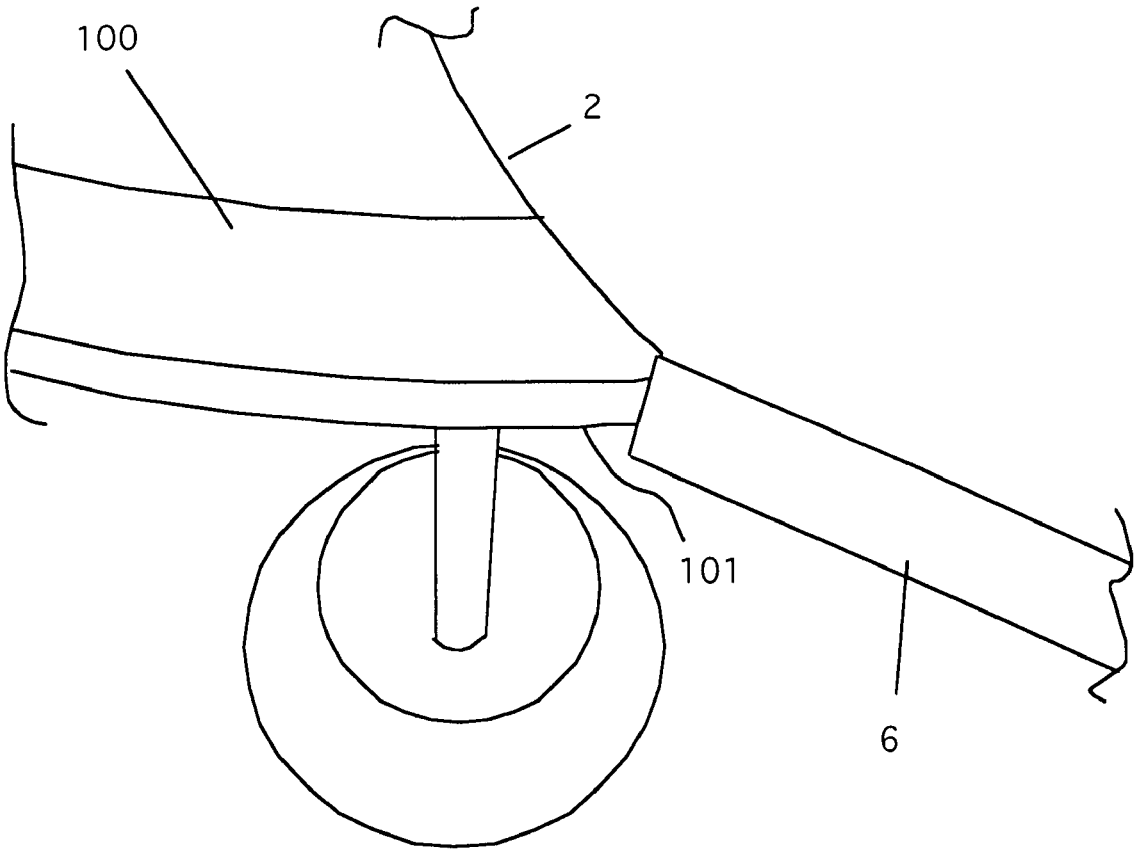
FIG. 5 is a detail perspective view of a table with the invention in place showing the overlapping top and the side flange, abutting the table.
Figure 7:
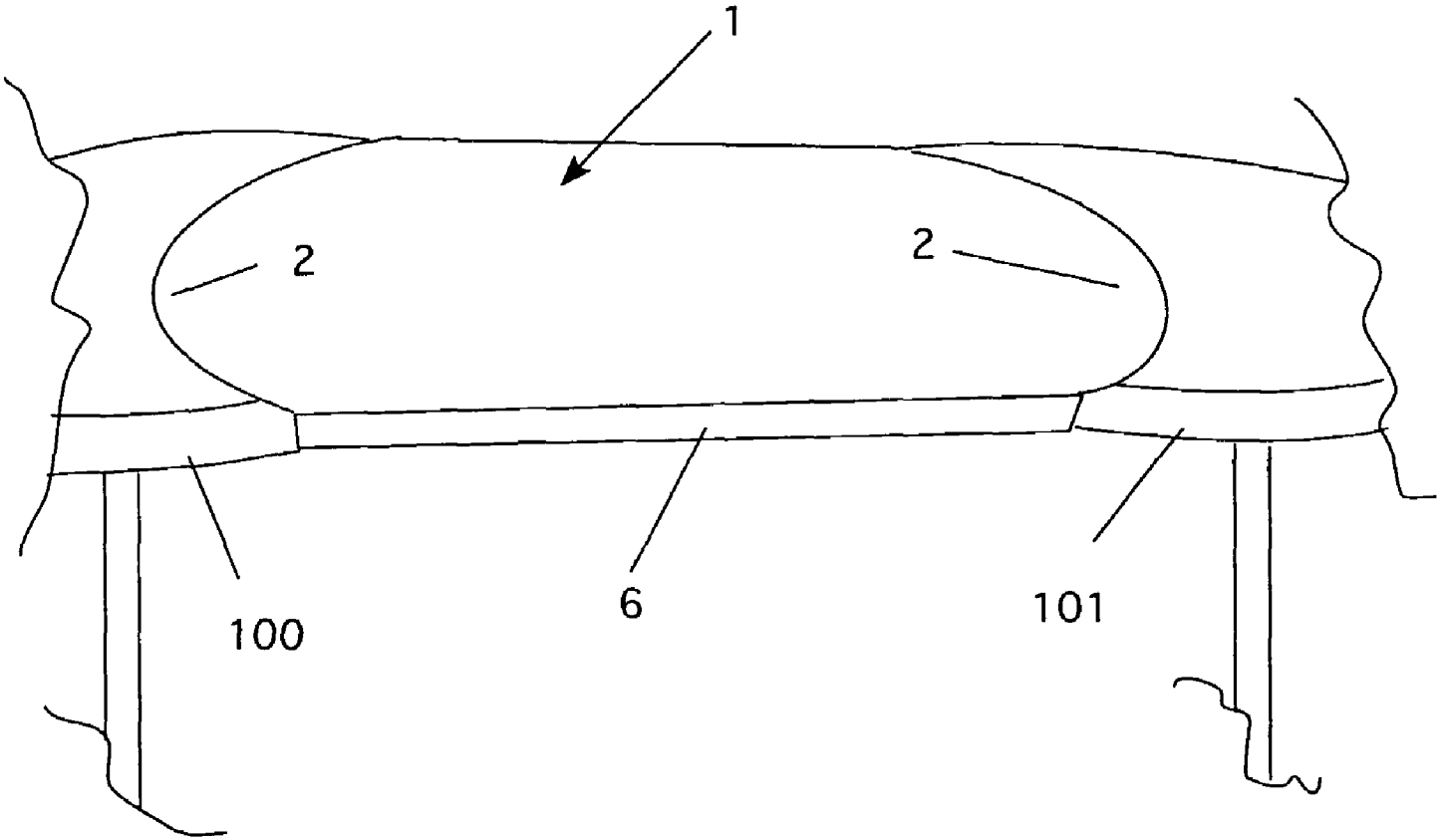
FIG. 7 is a detail view of the invention in place on two tables.

FIG. 5 is a detail perspective view of a table with the invention in place showing the overlapping edge 2 and the side flange 6, abutting the table 100. As discussed above, the edge 2 sits atop the table 100 when it is installed. The edge flanges 6 are cut to match the diameter of the curve so that they butt up against the table edge as shown. FIG. 7 shows the invention 1 placed on two tables 100 and 101.

Figure 8:
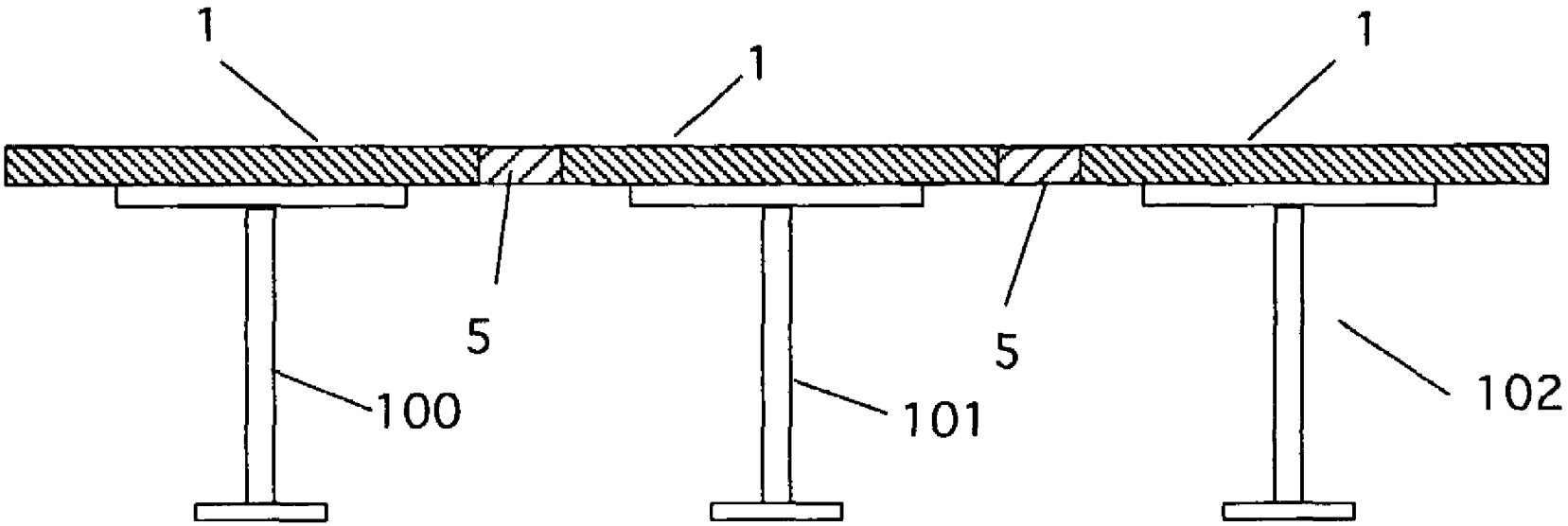
FIG. 8 is a side view of two table bridges set on three tables.

FIG. 8 shows two bridges that are used to span three tables 100, 101 and 102.

Figure 6:
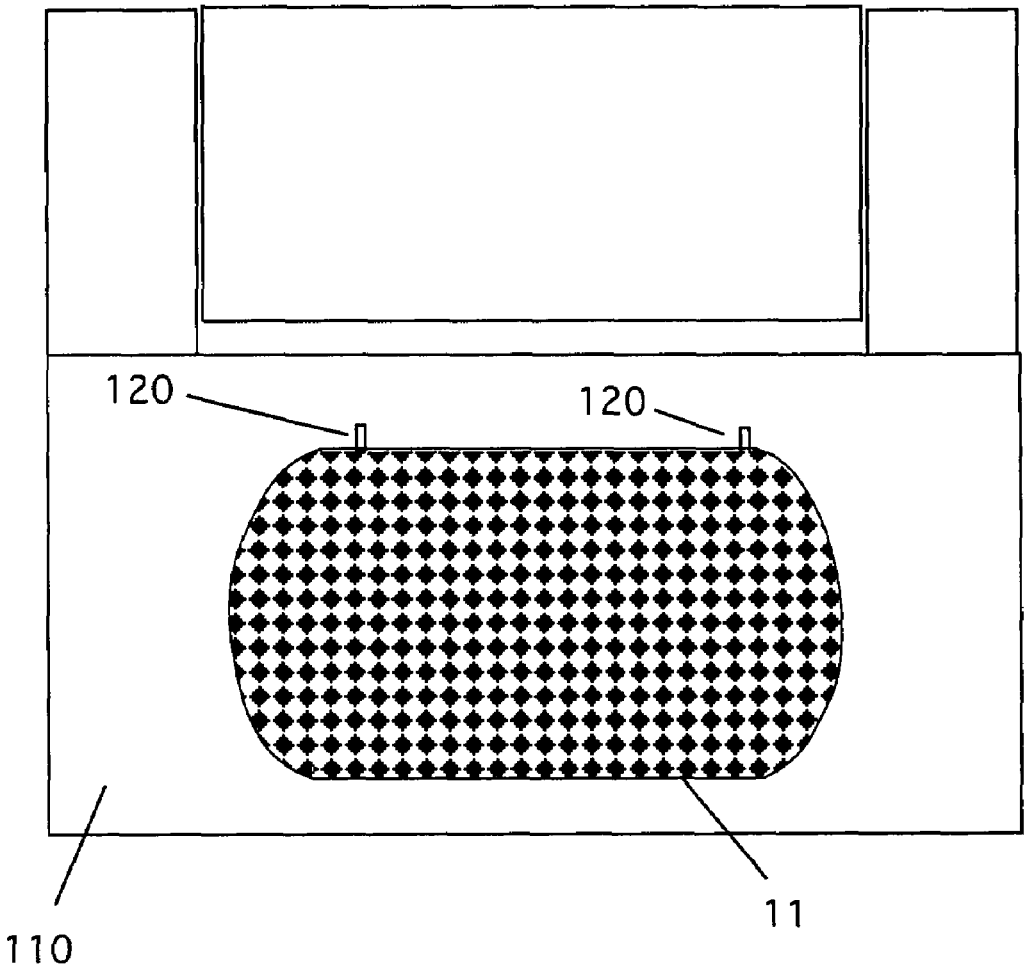
FIG. 6 is a detail view of the invention being stored on a wall.

FIG. 6 is a detail view of the invention being stored on a wall. As discussed above, one of the advantages of the bridge is that it can be "stored" by displaying it on a wall 110. The bridge can be hung horizontally, as shown, or vertically, as desired. The bridge is hung on the wall using simple brackets. As noted above, the bridges can be painted or otherwise decorated and can be grouped together as wall art. In this way, they present an appealing design when not needed at a table, but can be removed and positioned at two tables quickly and easily. Moreover, once the large party has left, the bridge can be removed and rehung without tools, with not much more difficulty than cleaning and setting an ordinary table.

Thus, two round tables that might seat a combined total of eight people can be combined to form a table that will now comfortably seat 12 people.

Finally, an additional benefit of these bridges is that they can span a variety of different distances between tables depending on the stability of the tables' legs. For example, a bridge that spans 1 foot from table edge to table edge produces a seating capacity virtually identical to two separate rounds (8 people). However, a three-foot separation of table edges increases the capacity substantially (e.g., 14 people). There is no limit to the diversity of the configurations that can be made. Multiple bridges can be put on additional tables to make tables that can seat the masses. Another variation allows the bridges to be centered on a table to enlarge that table's surface area and seating capacity. Still another variation allows a centered bridge to abut another centered bridge and be joined with side pins creating a different type of long table. For example, in FIG. 8, three tables are joined together with three bridges.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A bridge to connect a first and second table comprising:

a) a generally rectangular form having a first end and a second end, two straight and parallel sides, a top and a bottom, said generally rectangular form being formed of a single member;

b) a first curved member, fixedly attached to said bottom of said generally rectangular form and positioned adjacent to said first end;

c) a second curved member, fixedly attached to said bottom of said generally rectangular form and positioned adjacent to the second end;

d) a central circular member, attached to the bottom of said generally rectangular form, positioned in the center of the bottom of said form and extending downward therefore; wherein said bridge being positioned such that one of said two ends lies atop a top surface of said first table and said first curved member abuts an edge of said first table and said second of said two ends lies atop a top surface of a said second table and said second curved member abuts an edge of said second table, thereby forming a continuous flat surface between said first and second tables.

2. The bridge of claim 1 further comprising an edge flange formed on each of said two sides of said generally rectangular form, and extending downward therefrom.

3. The bridge of claim 1 wherein the top of said generally rectangular form has a decorative surface.

4. The bridge of claim 1 wherein the top of said generally rectangular form has a painted surface.

5. A bridge to connect tables comprising:

a) a generally rectangular form having two ends, two sides, a top and a bottom, said generally rectangular form being formed of a single member;

b) a first curved member, fixedly attached to said bottom of said generally rectangular form and positioned adjacent to one of said two ends;

c) a second curved member, fixedly attached to said bottom of said generally rectangular form and positioned adjacent to the other of said two ends; and d) a central circular member, attached to the bottom of said generally rectangular form, positioned in the center of the bottom of said form and extending downward therefrom; wherein the central circular member is adapted to fit over a table having a round top for expanding a table surface area.

6. The bridge of claim 5 further comprising an edge flange formed on each of said two sides of said generally rectangular form, and extending downward therefrom.

7. The bridge of claim 5 wherein the top of said generally rectangular form has a decorative surface.

8. The bridge of claim 5 wherein the top of said generally rectangular form has a painted surface.

9. A method of expanding seating space between two round tables comprising the steps of:

a) placing the two round tables in close proximity; and b) installing a bridge between the two round tables, wherein said bridge has a generally rectangular form being formed of a single member having two ends, two straight and parallel sides, a top and a bottom; a first curved member fixedly attached to said bottom of said generally rectangular form and positioned adjacent to one of said two ends; and a second curved member fixedly attached to said bottom of said generally rectangular form and positioned adjacent to the other of said two ends;

c) a central circular member, attached to the bottom of said generally rectangular form, positioned in the center of the bottom of said form and extending downward therefore; whereby, when said bridge is positioned for use on the two round tables, one of said two ends is placed atop a top surface of one of said two tables such that the first curved member abuts an edge of the first of two round tables while said other of said two ends is placed atop a top surface of the second of two round tables such that the second curved member abuts an edge of said second of two round tables.

10. The method of claim 9 further comprising the step of: removing said bridge from a wall surface where it is on display prior to installing said bridge on said two round tables.

11. The method of claim 9 further comprising the steps of:

a) removing said bridge from the two round tables after use; and b) hanging said bridge on a wall surface for display.

12. A method of expanding a table surface area comprising the steps of:

a) positioning a table having a round top in a desired location; and b) placing a bridge having generally rectangular form being formed of a single member having two ends, two sides, a top and a bottom, and edge flange formed on each of said two sides of said generally rectangular form; a first curved member, fixedly attached to said bottom of said generally rectangular form and positioned adjacent to one of said two ends; a second curved member, fixedly attached to said bottom of said generally rectangular form and positioned adjacent to the other of said two ends; and a central circular member, attached to the bottom of said generally rectangular form, positioned in the center of the bottom of said generally rectangular form on said table;

c) whereby the central circular member is aligned with said table and whereby said central circular member fits over the round top of said table.

13. The method of claim 12 further comprising the steps of:

a) positioning a second table also having a round top adjacent to said first table;

b) placing a second bridge having generally rectangular form being formed of a single member having two ends, two sides, a top and a bottom, and edge flange formed on each of said two sides of said generally rectangular form; a first curved member, fixedly attached to said bottom of said generally rectangular form and positioned adjacent to one of said two ends; a second curved member, fixedly attached to said bottom of said generally rectangular form and positioned adjacent to the other of said two ends; and a central circular member, attached to the bottom of said generally rectangular form, positioned in the center of the bottom of said generally rectangular form on said table such that the central circular member fits over the round top of said second table;

c) positioning the first and second tables in an adjacent position such that one end of the first bridge aligns with one end of the second bridge; and;

d) attaching a pair of splicing members to the edge flanges on the first bridge and the second bridge such that said first bridge and said second bridge are connected between the first and second tables.

14. The method of claim 13 further comprising the steps of:

repeating steps a-d with a third table, to connect three tables together.

15. The method of claim 12 further comprising the step of: removing said bridge from a wall surface where it is on display prior to installing said bridge on said table.

16. The method of claim 12 further comprising the steps of:

a) removing said bridge from the table after use; and b) hanging said bridge on a wall surface for display.

* * * * *